United States Patent [19]

Neff

[11] Patent Number: 4,606,592

[45] Date of Patent: Aug. 19, 1986

[54] ELECTRICAL CONNECTOR ASSEMBLY WITH INTEGRAL PLUG AND SOCKET MODULES

[75] Inventor: Ralph D. Neff, Pittsfield, N.H.

[73] Assignee: Vernitron Corporation, Lake Success, N.Y.

[21] Appl. No.: 619,584

[22] Filed: Jun. 11, 1984

Related U.S. Application Data

[63] Continuation of Ser. No. 359,355, Mar. 18, 1982, abandoned.

[51] Int. Cl.[4] ..... H01R 9/24

[52] U.S. Cl. ..... 339/59 M; 339/198 P; 339/206 P

[58] Field of Search ..... 339/96, 176 M, 198 P, 339/198 S, 206 R, 206 P, 207 R, 59 R, 59 M

[56] References Cited

U.S. PATENT DOCUMENTS

| | | | |
|---|---|---|---|
| 2,688,123 | 8/1954 | Benham et al. | 339/176 M |
| 3,395,382 | 7/1968 | Weagant | 339/209 |
| 3,474,388 | 10/1969 | Jackson et al. | 339/92 R |
| 3,745,512 | 7/1973 | Johnson et al. | 339/59 M |
| 3,798,587 | 3/1974 | Ellis, Jr. et al. | 339/91 R |
| 3,842,389 | 10/1974 | Glover et al. | 339/60 M |
| 3,874,760 | 4/1975 | Guthmiller et al. | 339/209 |
| 3,989,338 | 11/1976 | Gosser | 339/96 |

FOREIGN PATENT DOCUMENTS

| | | | |
|---|---|---|---|
| 1300134 | 6/1962 | France | 339/176 M |

*Primary Examiner*—Gil Weidenfeld
*Assistant Examiner*—Gary F. Paumen
*Attorney, Agent, or Firm*—Edward H. Loveman

[57] ABSTRACT

An electrical connector assembly has socket and plug connectors. Each connector comprises a block of dielectric plastic in which are tapered cavities containing pyramidal modules which have two sections forming a casing enclosing an electrical contact. The modules of the socket connector contain spring contacts located at socket openings in the module casings. Each module of the plug connector contains a rigid bar which extends as a prong out of the smaller end of each plug module to fit into a socket at the smaller end of a socket module in the socket connector. Other ends of the contacts in all modules extend out of larger ends of the modules and carry screws for attaching circuit wires. The dielectric casings of all modules may be thermally bonded to the walls of the cavities in the dielectric plastic blocks.

6 Claims, 14 Drawing Figures

ELECTRICAL CONNECTOR ASSEMBLY WITH INTEGRAL PLUG AND SOCKET MODULES

This is a continuation of application Ser. No. 359,355 filed Mar. 18, 1982, now abandoned.

This invention relates to electrical connectors and more particularly concerns an electrical connector assembly of the type having interfitting plug and socket connectors.

Electrical connectors heretofore known and designed to provide a multiplicity of plugs or sockets have generally been formed of moldable plastic blocks in each of which is an electrically conductive strip or plate carrying a multiplicity of socket or plug contacts. Once the contact block is molded enclosing the socket or plug contacts, the number of sockets and plugs cannot be increased. The present invention takes another approach to the problem of providing electrical plug and socket connectors of simplified, more rugged construction embodying a multiplicity of interfitting plugs and sockets.

According to the invention, premolded dielectric carrier blocks are each provided with a multiplicity of tapered cavities for receiving pyramidally shaped modules. Each module comprises a dielectric casing having two identical half sections which enclose part of an electrically conductive plug or socket contact. The modules containing a selected contact may be inserted into a cavity in a premolded plug or socket block. Any desired number of modules may be press-fitted into a connector block. Then the modules may be secured in place by thermally bonding the modules to the dielectric block.

One or more cavities in each carrier block may be provided with a frangible wall which can be knocked out so the block can receive any desired number of plug or socket modules up to the maximum capacity of the block.

It is therefore a principal object of the present invention to provide a modular molded plastic connector block having cavities in which socket or plug modules can be inserted and thermally set in place.

A further object of the present invention is to provide a plug and socket module each having two identical bilateral halves adapted to receive and retain a spring contact or a plug contact.

Another object of the present invention is to provide an electrical connector having interfitting modular plug and socket blocks carrying integrally bonded modules having plug and socket contacts and means for connecting circuit wires thereto.

Still another object of the present invention is to provide an electrical connector of simplified rugged construction employing a lesser number of parts than prior connectors and adapted for mass production at low cost by simple manufacturing procedures.

These and other objects and many of the attendant advantages of this invention will be readily appreciated as the same becomes better understood by reference to the following detailed description when considered in connection with the accompanying drawings in which.

Figure 1:
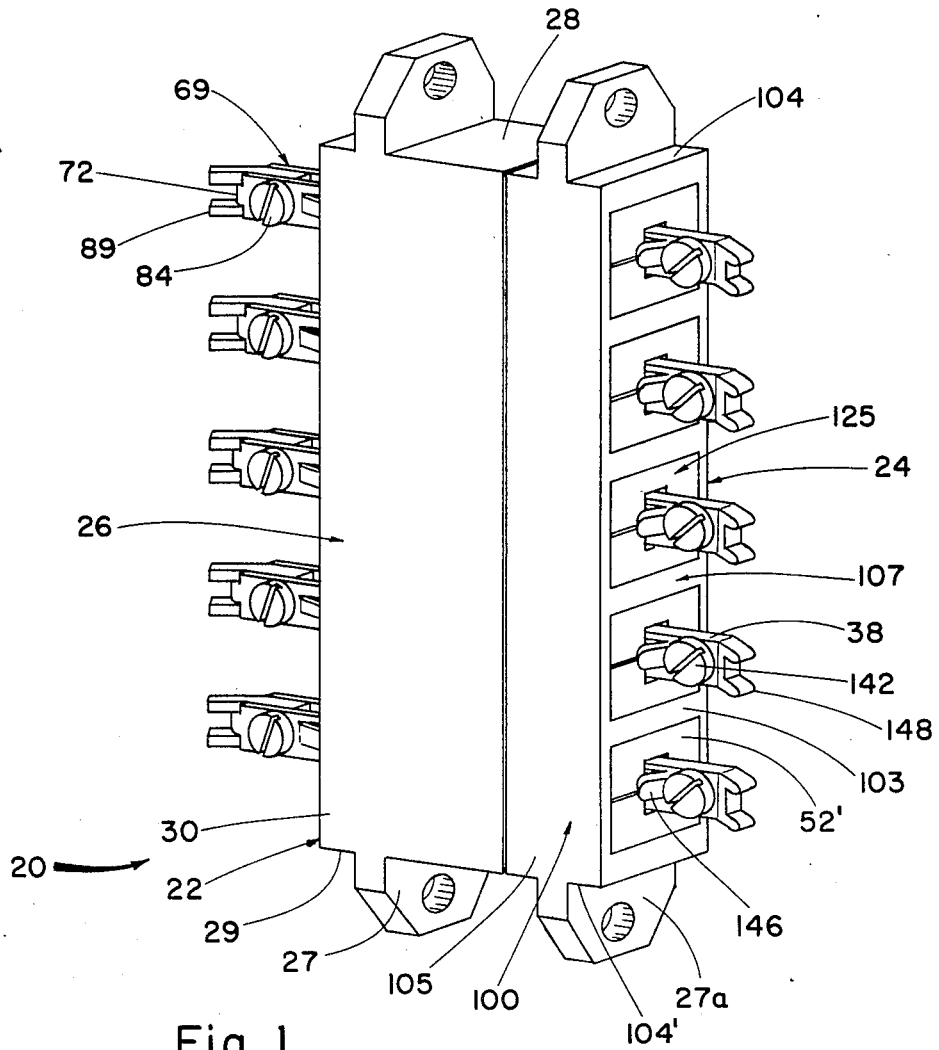
FIG. 1 is a perspective view of a connector assembly embodying the invention, with plug and socket connectors shown in detachable engaged position.
Figure 4:
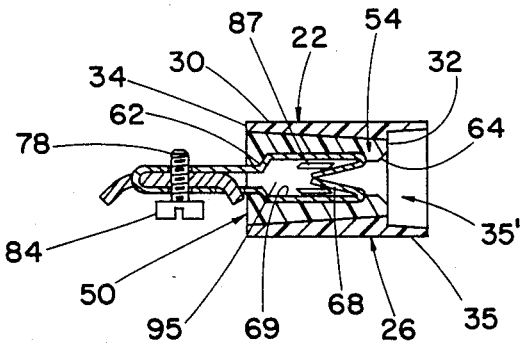
FIG. 4 is a cross sectional view taken along line 4—4 of FIG. 2 through the socket connector block.
Figure 5:
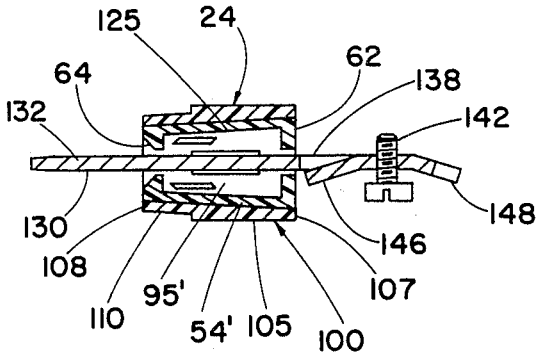
FIG. 5 is a cross sectional view taken along line 5—5 of FIG. 2 through the plug connector block.
Figure 2:
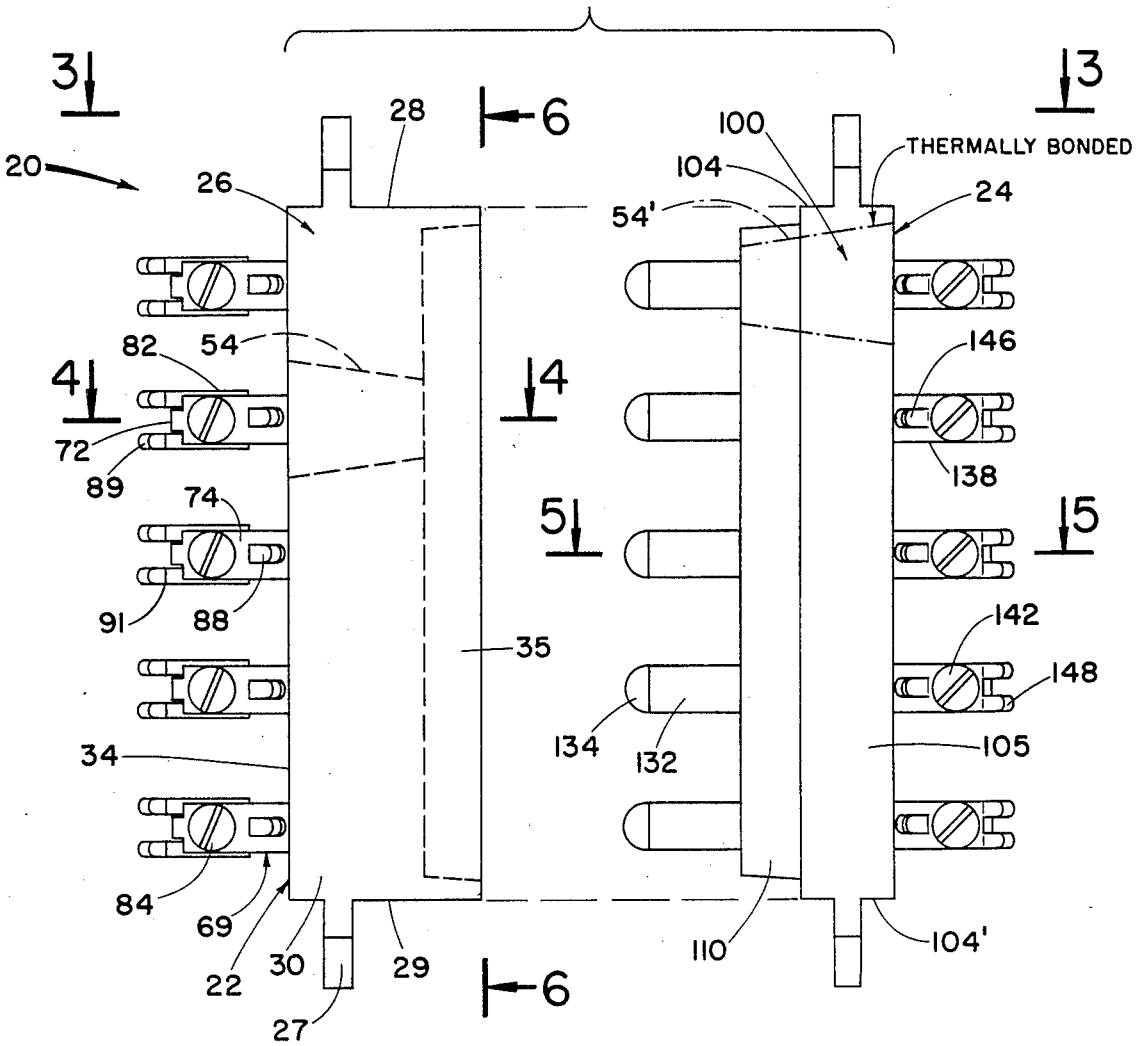
FIG. 2 is a side elevational view of the connector assembly with plug and socket connectors shown in disengaged position.
Figure 3:
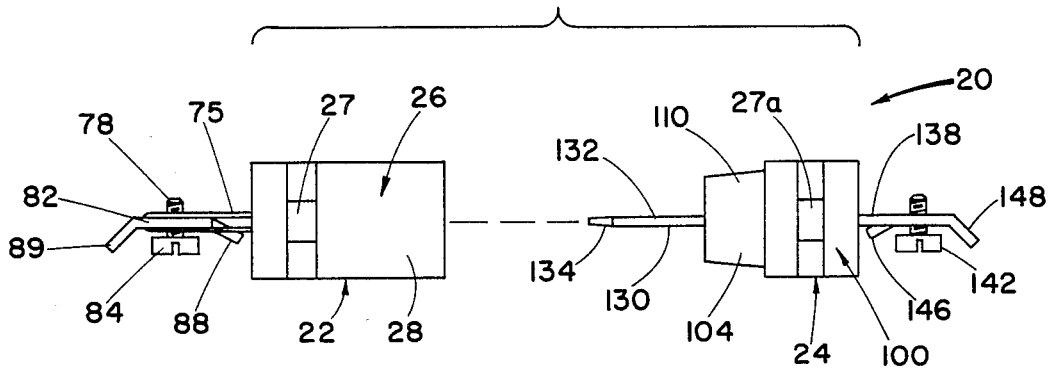
FIG. 3 is a top plan view of the connector assembly taken along line 3—3 of FIG. 2.
Figure 6:
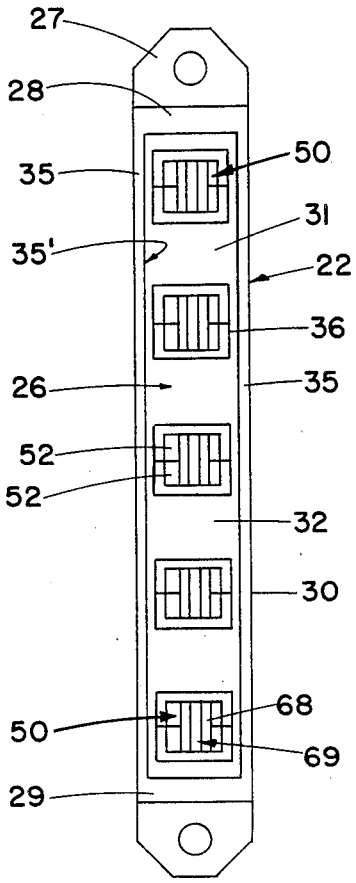
FIG. 6 is a front elevational view taken along line 6—6 of FIG. 2 showing the front face of the socket connector block.

Referring now to the drawings wherein like reference characters desinate like or corresponding parts throughout, there is illustrated in FIGS. 1, 2, and 3, a connector assembly generally designated as reference numeral 20 including a multiple socket connector 22 and a multiple plug connector 24.

Figure 7:
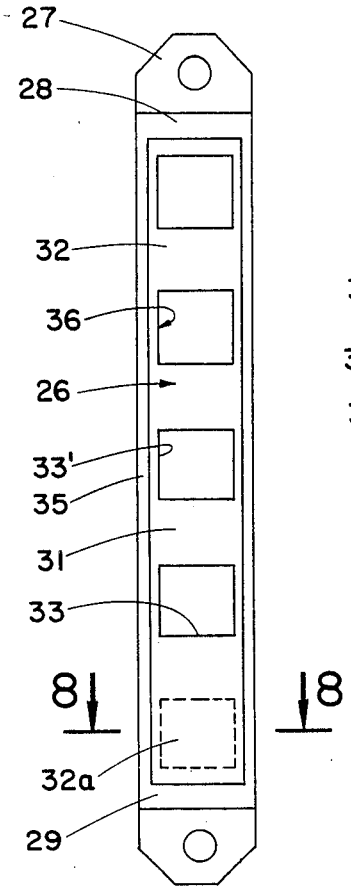
FIG. 7 is a front elevational view similar to FIG. 6, of a socket connector block without socket modules.
Figure 8:
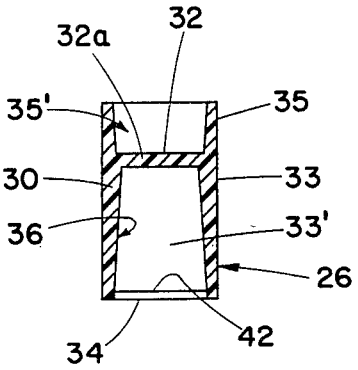
FIG. 8 is a cross sectional view taken along line 8—8 of FIG. 7.

The socket connector 22 includes a premolded plastic dielectric rectangular block 26 (shown in FIG. 1-4, 6-9) which has integral apertured ears 27 extending outwardly of respective transverse top and bottom walls 28, 29 for mounting the block 26 on a rack by screws, bolts, rivets, etc. . . The block 26 has imperforate parallel rectangular side walls 20 and rectangular apertured front and rear sides 32, 34. The block 26 has spaced transverse partitions 31 (FIG. 7) which define a plurality of cavities 36. Each of the cavities 36 has flat interior sides 33, 33' which flare away from each other between the front and the rear walls 32, 34. The smaller end of each cavity is thus at the front and the larger end is at the rear of the block 26. The side, top and bottom walls 30, 28, and 29 of the block 26 are extended forwardly beyond the front wall 32 to form a rectangular frame 35 which defines a recess 35' to receive the plug connector 24. The cavities 36 are open at both the front and rear of the block 26. These cavities receive socket modules 50 as best shown in FIGS. 4, 6, 9, and 14. If desired, one or more of cavities 36 in the block 26 can be closed off by a thin frangible wall **32*a* at the front of the block 26 as illustrated in FIGS. 7 and 8. The rear ends of the cavities 36 are provided with ledges 42 which serve as abutments for ridges 44 formed on the wider ends of the modules 50; see FIGS. 9 and 14**.

Figure 9:
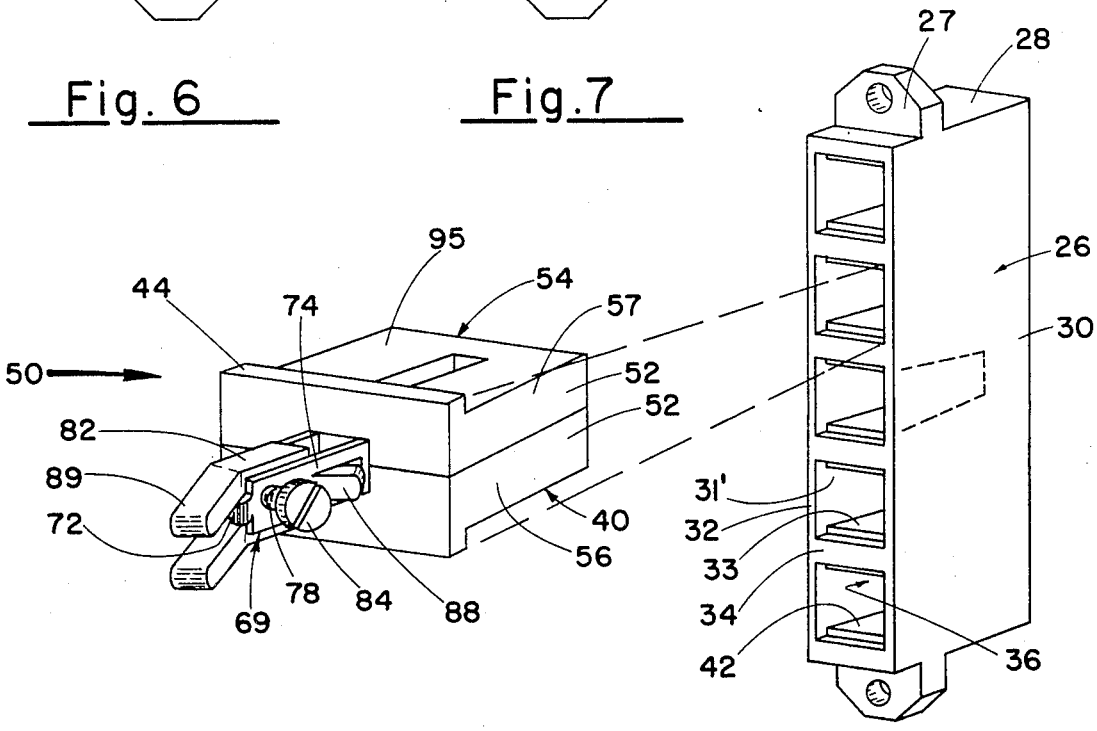
FIG. 9 is an exploded perspective view of a socket connector block and a socket contact module.
Figure 10:
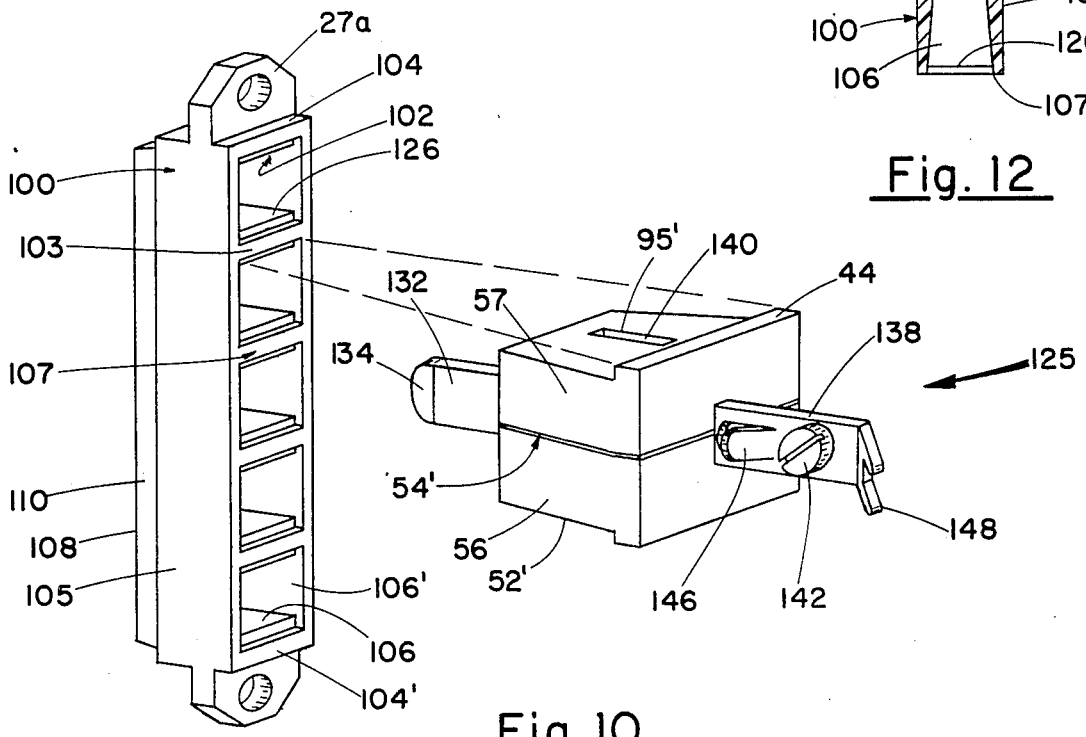
FIG. 10 is an exploded perspective view of a plug connector block and plug contact module.

Each module 50 has two identical dielectric half sections 52, together, defining a dielectric casing 54 having the shape of a quadrilateral pyramid when the sections are abutted as shown in FIGS. 9 and 10. Each half section 52 is formed with side walls 56, 57 which taper inwardly between longer and wider end-wall 58 and shorter and narrower end wall 60 best shown in FIG. 14. A narrow slot 62 is formed in each end wall 58 and a wider slot 64 with inwardly tapered sides is formed in the end wall 60. Fingers 68 of a contact spring 69 fit into the cavity 70 defined between side and end walls of each module section 52. Each of the contact springs 69 is formed from a single strip of bent metal which is bent into U-shape. The fingers 68 are at inwardly bent ends of the spring 69 opposite a bight 72. In side walls 74, 75 of the spring 69 are registering holes 76, which receive a screw 78 inserted through a threaded hole 80 in a nut 82 inserted between the side walls 74 and 75 near the bight 72. A circuit wire 83 can be engaged on the screw 78 between a screwhead 84 and the side wall 74. The side wall 74 also has a rectangular hole 86 to receive a lug 88 formed at one end of the nut 82 to anchor the same inside the spring 69. The nut 82 also has outwardly extending lugs 89 extending through notches 91 in bight 72 to assist the lug 88 in anchoring the nut 82 in the spring 69 and to engage clamps (not shown) for holding circuit wire 83 on the screw 78. Projections 87 on the inside of casing walls 95 engage bent ends of the spring fingers 68.

A pair of upward extensions 90 are formed on an edge 93 of the side wall 57, and short recesses 92 are formed on the edge 93 of the side wall 56. When the two sections 52 of the module casing 54 are abutted, the extensions 90 on the side wall 57 interfit with the recesses 92 in the sidewall 56.

When the two sections 52 of the module 50 are abutted as shown in FIG. 9 with the spring fingers 68 of the spring 69 enclosed by the module casing 54 the module 50 can be inserted through the larger end of any one of the selected cavities 36 in the block 26. The modules 50 are dimensioned to form a tight frictional fit in each of the cavities 36. The modules 50 can then be locked in place thermally by applying heat to set the plastic dielectric. This will integrally join outer walls of each module casing 54 with interior walls 33, 33', of the cavity 36 in which the module 50 is set. The spring fingers 68 define socket members to receive and engage prongs of the plug connector 24.

The plug connector 24 has a rectangular molded dielectric plastic block 100 (shown in FIGS. 1, 2, 3, 5, 10, 11 and 12) with a plurality of cavities 102 each formed by a transverse partitions 103*a*, a top wall 104*a*, bottom wall 104' and a side wall 105. Interior walls 106 taper inwardly between a rear end wall 107 and a front end wall 108. The larger ends of the cavities 102 are thus at the rear end wall 107 and the smaller ends are at the front end wall 108. The block 100 is formed with a rectangular extension 110 of the side walls 105 and transverse walls 104, 104' to define a tenon which fits snugly and frictionally inside the frame 35 of the block 26. The frame defines a recess with the front wall 32 of the block 26 to receive and engage the extension 110 at the front end of the block 100.

A plurality of plug modules 125 (as shown in FIGS. 1, 5, 9, and 13) each have a dielectric plastic casing section 52' which is identical in construction to sections 52 of the modules 50 and form quadrilateral pyramidal casings 54' when abutted. The side walls 56, 57 of the modules 125 are tapered to fit into the correspondingly shaped cavity 102. A ledge 126 in block 100 serves as an abutment for the ride 44 on the modules 50. Each module 50 has an electrical contact 130 formed from a rigid strip or bar of metal with a flat prong 132 with a rounded, thinned free end 134 to fit easily but snugly between the contact fingers 68 of each socket spring 69 in the connector 22. Near the center of the contact 130 are flanges 135 extending outwardly from lateral edges 136 to engage in slots 140 formed in outer side walls 95' of each of the module sections 52 beyond the flanges 135 the contact 130 has a flat portion 138 formed with a threaded hole 141 to receive a screw 142 on which a circuit wire 144 may be engaged. A tongue 146 is struck out from the section 138 to assit retaining the wire 144 beneath the screw head 142. A pair of lugs 148 at the free end of the section 138 are adapted to receive a clamp (not shown) for holding the wire 144 in place. Other parts of the plug module 125 are identical to that of the module 50 and corresponding parts are identically numbered and serve functions already described above.

Figure 12:
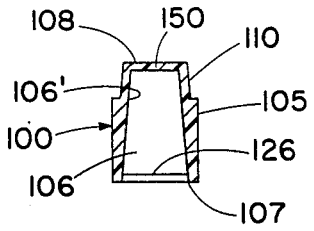
FIG. 12 is a cross sectional view taken along line 12—12 of FIG. 11.
Figure 11:
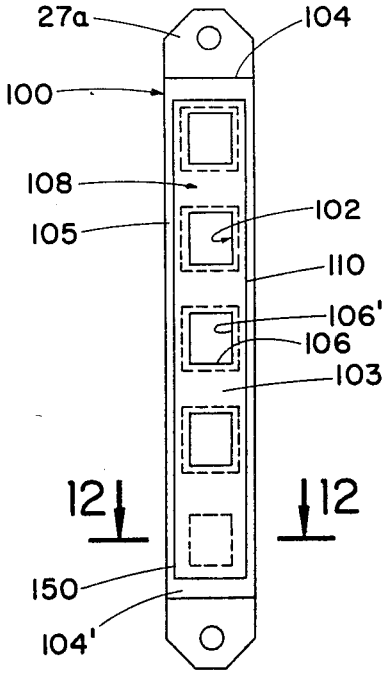
FIG. 11 is a front elevational view of a plug connector block without plug modules.
Figure 13:
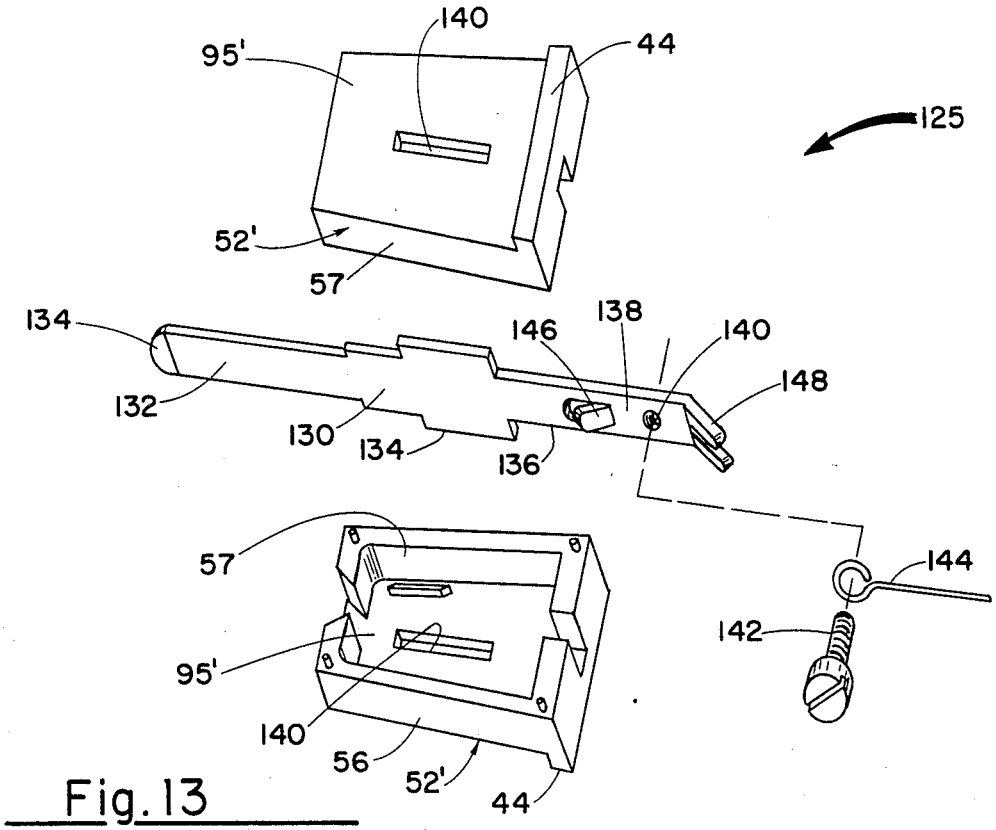
FIG. 13 is an enlarged exploded perspective view of parts of a plug contact module.
Figure 14:
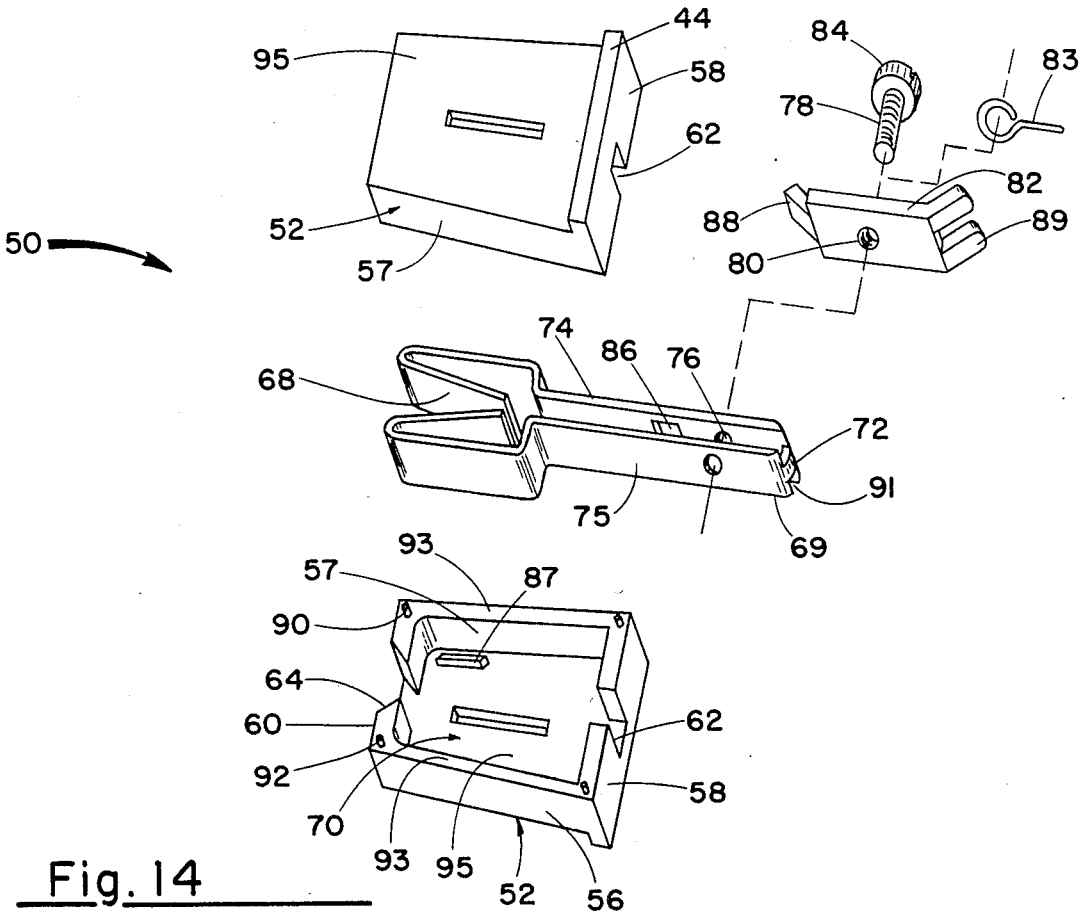
FIG. 14 is an enlarged exploded perspective view of parts of a socket contact module.

The block 100 may have one or more cavities 102 blocked off by a frangible wall 150 at narrow ends of the cavities 102 as shown in FIGS. 11 and 12 and these walls can be easily broken out to receive the plug modules 125.

When the plug modules 125 are assembled as shown in FIGS. 1, 2, 3, 5, and 10, the prongs 132 will extend outwardly of the smaller end of the plug module 125 and the wire engaging section 138 will extend out of the wider end of the plug module 125. The plug modules 125 can be snugly, frictionally press fitted into the cavities 102 and then locked in place by applying heat to set the plastic dielectrtic. The plug modules 125 will then be integrally secured in the block 100. All of the prongs 132 will extend outwardly from the front of the block 100 in coplanar alignment to engage in the correspondingly disposed sockets in the block 26. Apertured ears 27*a* at opposite top and bottom ends of the connector block 100 facilitate securing the connector 24 on a rack or panel after the prongs 132 are engaged in the sockets of the connector 22.

It will be noted that the connectors can be assembled by mass production methods with a minimum of manual labor. The assembled connectors are strong, and will provide long,k useful, trouble-free service.

It should be understood that the foregoing relates to only a preferred embodiment of the invention which has been by way of example only, and that it is intended to cover all changes and modifications of the example of the invention herein chosen for the purpose of the disclosure, which do not constitute departures from the spirit and scope of the invention.

What is claimed is:

1. An electrical connector assembly comprising:

mutually interfitting dielectric socket and plug connector blocks;

each of said blocks having spaced side walls joined by integral transverse walls defining a plurality of cavities in each block open at opposite ends of each block;

each of said cavities having smaller and larger opposite ends defined by tapered interior walls;

a first plurality of modules wholly within said socket connector block, each module having a shape of a quadralateral pyramid;

a second plurality of modules wholly within said plug connector block, each module having a shape of a quadralateral pyramid; and each of said modules in each of said blocks comprising a casing defined by two identical dielectric module sections abutted together and retaining a first portion of and enclosing an electrical contact member, each contact member having another portion extending out of said casing for attaching a circuit wire thereto.

2. An electrical connector assembly as defined in claim 1, wherein said block has a frame recess at one end thereof formed by extensions of said outer walls of said block and defining a recess for receiving and engaging a correspondingly shaped frame of another connector block.

3. An electrical connector assembly as defined in claim 1, wherein said block has a rectangular tenon at the end thereof defined by extensions of outer walls of said block for seating in a correspondingly shaped recess of another connecting block.

4. An electrical connector assembly as defined in claim 1, wherein said first modules in said socket connector block have openings in one end of each casing defining a socket; said first portion of said electrical contact member in each module in said socket connector block having closely spaced spring fingers for detachable engaging a prong of a plug connector block.

5. An electrical connector assembly as defined in claim 4, wherein said second plurality of modules in said plug connector block have a plurality of coplanar flat prongs extending out of said second modules and integral with said first portions of said electrical contact members in said casings of said second modules, for detachably engaging with a pair of said spring fingers adjacent each socket opening in said socket connector block.

6. An electrical connector assembly as defined in claim 1, wherein each of said blocks has other cavities closed by frangible walls, which can be broken for insertion of others of said modules into said other cavities.

* * * * *